United States Patent [19]

McGough

[11] 4,386,690

[45] Jun. 7, 1983

[54] COIN RELAY SELECTOR CARD

[75] Inventor: Gerald B. McGough, Huntsville, Ala.

[73] Assignee: GTE Automatic Electric Labs Inc., Northlake, Ill.

[21] Appl. No.: 220,668

[22] Filed: Dec. 29, 1980

[51] Int. Cl.[3] ..... G07F 9/04

[52] U.S. Cl. ..... 194/1 D; 232/57.5

[58] Field of Search ..... 194/101, 1 D; 232/57.5; 248/206 A

[56] References Cited

U.S. PATENT DOCUMENTS 598,545 2/1898 Volkmann ..... 194/101 X 3,759,440 9/1973 Hamilton et al. ..... 232/57.5

*Primary Examiner*—F. J. Bartuska

*Attorney, Agent, or Firm*—Robert J. Black; Charles A. Doktycz

[57] ABSTRACT

An improved selector card assembly for use in a paystation coin handling mechanism wherein the polarizing magnet normally molded into the end of the card is mounted onto the card by a pair of tines and a central saddle like tongue portion. Thus leaving the polarizing magnets poles exposed and closer to the coin magnet core extensions.

4 Claims, 4 Drawing Figures

COIN RELAY SELECTOR CARD

BACKGROUND OF THE INVENTION (1) Field of the Invention

The invention described herein generally relates to the field of coin handling mechanisms such as the coin disposal mechanisms for telephone paystations and in particular to the selector card used in such mechanisms.

(2) Description of the Prior Art

One of the prior art mechanisms used in coin handling is represented by U.S. Pat. No. 3,759,440 issued to R. J. Hamilton and G. G. McGough. In this patent's coin disposal mechanism, coins deposited into the telephone fall into the coin hopper which includes a pair of pivotally mounted doors upon which the coins rest until a determination is made whether to refund or collect these coins. Each door has an individual latch and a biasing means which cooperates with the latch to normally hold the doors in an unoperated position. The mechanism also includes an electromagnet, an armature therefor and a selector card having magnetic biasing means included therein. Upon receipt of an appropriate signal, the electromagnet is energized to pivot the selector card and ultimately opens one or the other of the pair of doors. The direction of electrical current flowing through the electromagnet determines the polarity thereof and the flux emanating from the electromagnet pivots the selector card to preposition the card for moving a predetermined door to the operated position. Upon continued actuation of the electromagnet, the electromagnets armature movement moves the selector card to engage the latch associated with a predetermined door, allowing the door to rotate to the operated position and any deposited coins to fall into the passageway individual to the operated door. Upon release of the electromagnet, the operated door is returned to the unoperated position and its respective latch and biasing arrangement retains the door in the unoperated position. In a similar manner, if the current flow through the electromagnet had been in the opposite direction, the selector card would have pivoted such that upon continued application of current to the electromagnet, the armature would have moved the selector card to engage the other latch and release the other door. Upon de-energization of the electromagnet, the latch and corresponding operated door would be returned to the unoperated position wherein the latch and its associated biasing means retain the door in the unoperated position until the electromagnet is again energized to release a latch and door combination.

The function of the selector card assembly is to transfer the motion of the coin relay armature to operate either the collect or refund hopper door. It selects the proper door by either tilting slightly clockwise or counterclockwise when the coin relay is energized. Then it moves downward to selectively trip the collect or refund door latch.

The tilting of the selector card is caused by magnetic interaction of the permanent magnet of the selector card assembly and the magnetic pole from the coin relay coil. The selector card magnet will be attracted at one end and repelled at the other depending upon the polarity of the pole. The selector card magnet is located at the top of the selector card and must be in close proximity to the magnetic lead for proper operation.

The downward motion of the selector card follows the tilting motion. This motion trips the proper hopper door latch and opens the door. The selector card returns, when the coin relay is deenergized, to the straight up and down position.

Prior to the invention of this new selector card assembly, the industry accepted method for holding the polarizing magnet was to mold it into place. One of the disadvantages of this method is that production operators burned their fingers when loading magnets into the hot mold.

SUMMARY OF THE INVENTION

The present invention consists of improvements to the aforementioned selector card assembly, and especially in its method for assembling the polarizing magnet to the card.

First the selector card is molded and then in a separate operation, the polarizing magnet is assembled to the card. The selector card magnet is assembled into the selector card by pushing it into place. Two projections of the selector card snap over either end of the magnet, while a central projection restrains it from movement out of the plane of the card. Each of the two end projections has a ramp arrangement for guiding the magnet during assembly. The projections provide force in two directions to keep the magnet both centered and rigidly fixed in place with no play. Thus, besides eliminating a hazardous operation, in this novel design for retaining the polarizing magnet, it also permits the replacement of the magnet should it prove defective, or for repositioning if improperly polarized.

BRIEF DESCRIPTION OF THE DRAWINGS

FIG. 2A is a sectional view of the tongue like projection along lines 2A—2A.

FIG. 2B is a sectional view of one of the projections adjacent the tongue along lines 2B—2B.

DESCRIPTION OF THE PREFERRED EMBODIMENT

Figure 1:
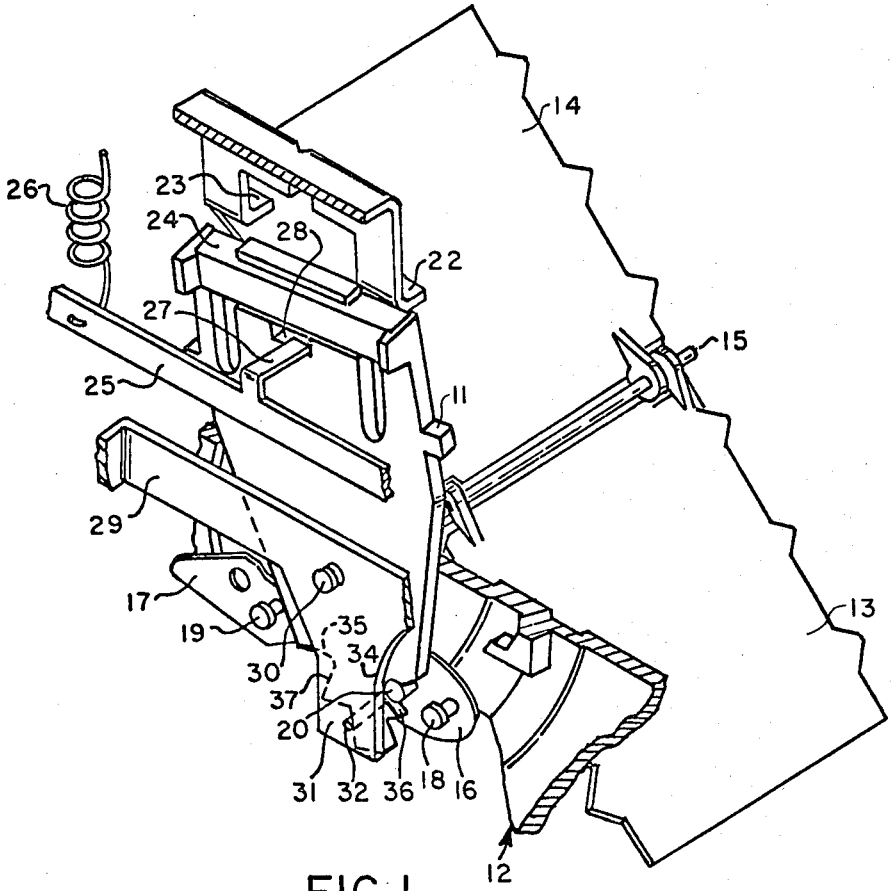
FIG. 1 is a perspective view of a coin disposal mechanism shown in a partial cut away to better illustrate the relative parts relationships of the components when the selector card has been rotated to operatively control one of the doors to the operated position.

FIG. 1 shows the selector card 11 in an operational environment. The hopper chute for the coins is not shown except for the portion 12 which supports the hinge pin 15 on which are pivotted the two doors 13 and 14. As illustrated in the FIG. 1, it will be noted that door 13 is in the operated position, thus it serves as the bottom of a portion of the passageway to which it controls access. Door 14 when operated similiarly controls access to its associated passageway. These doors are moved by latches which are not shown in their entirety, only their corresponding projections 16 and 17. Each of these latch projections 16 and 17 as well as the remainder of the latch which is not visible in FIG. 1 is pivotally mounted on an associated hinge pin 18 and 19 respectively. Also, mounted on this latch projection 16 is an activating pin 20 shown on projection 16. Projection 17 has a similar pin which is not visible in the view of FIG. 1.

The components of the coin relay assembly that are visible in FIG. 1 are the core extensions 22 and 23 operatively associated with the polarizing magnet 24 of selector card 11. A portion of the armature of the coin relay that is shown is the yoke 25. It has a projection 27 arranged to fit into a cavity 28 of the selector card 11. Also attached to this yoke is a spring 26 which serves to bias the armature assembly into the non operated position. Spring 26 is rigidly affixed at its other end to an extension of the core assembly that is not shown. A yoke 29 extends from both sides of the coin relay core and serves to support selector card 11 for pivotal as well as vertical movement. This movement is limited by screw 30 having a large head opposite the end which can be seen extending through the yoke 29 in FIG. 1. It will be noted that yoke 29 has a lower extending ear 31 which includes a pin 32 extending outwardly toward the hopper assembly.

Figure 2:
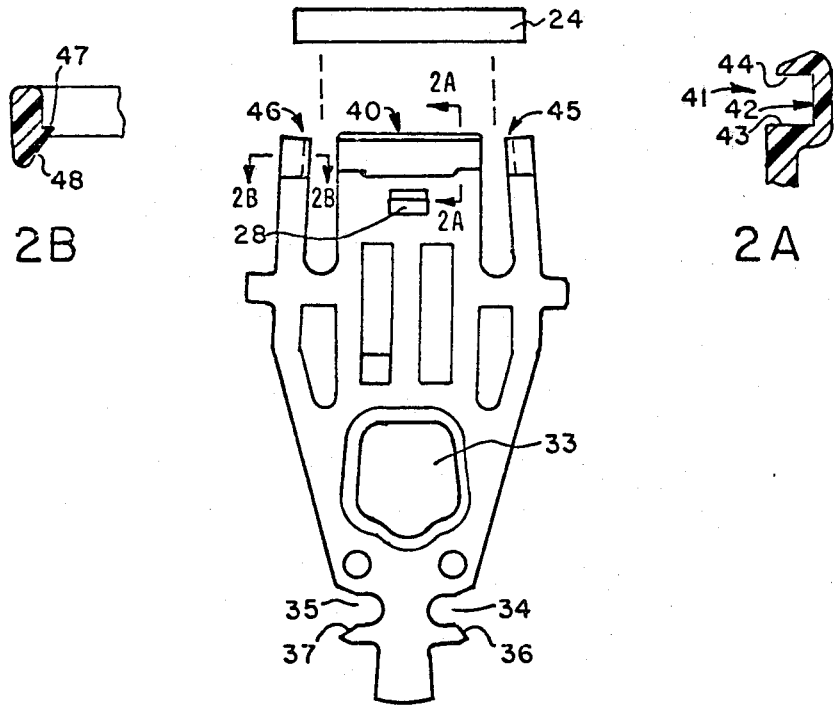
FIG. 2 is a plan view of the selector card showing the location of the magnet retaining components.

Selector card 11 includes an aperture 33, see FIG. 2, through which screw 30 passes and which allows the card to rotate as well as slide vertically with respect to screw 30. The arm 27 of the armature yoke 25 extending through opening 28 in the selector card serves to actuate the card. Thus it will be appreciated that when the core of the electromagnet is energized the armature is attracted to the core and yoke 25 with its arm 27 will of course, follow the armature movement in a downward direction. As can be seen pin 32 lies directly below the lower tip of selector card 11 and prevents its downward movement unless it has first been rotated.

From the foregoing it will be appreciated that in order for selector card 11 to open either of the doors, the selector card must first be prepositioned to the left or right of pin 32 so that it may then be moved downward. The pre-positioning force is supplied to the selector card 11 by the flux which emanates from the ends 22 and 23 of the pole piece when the coil is energized. This flux influences permanent magnet 24 which is mounted along the upper edge of selector card 11, and pivots card 11. Bar magnet 32 is magnetized longitudinally, i.e. for example if the end of bar magnet 24 adjacent pole end 23 were north, the end adjacent pole end 22 would be south.

When the coil is energized with current flowing in a first direction, the upper end of pole piece will assume, for example a magnetism of say the north direction and the lower end of pole piece a south direction, and if the current in the coil 11 were flowing in the opposite direction, the upper end of the pole piece would appear as a south pole and the lower end a north pole. Thus it will be appreciated that when the coil is energized the pole ends will both exhibit either a north or a south magnetization polarity and, for example, if the coil is energized such that the upper end of the pole piece assumes a northerly magnetization, selector card 11 will be pivoted as illustrated if the bar magnet 24 has its left end of a north polarity.

The selector card 11 includes a pair of notches 34 and 35, which upon rotation and downward movement of the card will engage either projection 20 as shown or a corresponding projection on the other side that is not shown, to operate either one of the latch arms 16 or 17. Upon de-energization of the coil the selector card will be pulled upward. During this movement projections 36 and 37 will engage the projections such as pin 20 to return the latches to their normal position.

It can readily be seen from the above description of the environment of the selector card that its dimensions and overall size are very critical and that therefore the arrangememnt for retaining the polarizing magnet on the card is constrained.

Looking at FIG. 2 it can be seen that the card is of a generally deltoid shape, with three projections from the upper end. A central tongue like projection 40 having formed therein a saddle like depression 41 with a section view at 2A for confining the magnet on the back side 42, the bottom side 43, and on the top at 44. The two other projections 45 and 46, one on each side of the central projection serve to resiliently position the magnet when it is placed in the central saddle, axially between themselves and against the back portion 42. This latter action is performed by the projections such as 47 shown by section 2B. A ramp like surface 48 on each projection facilitates the insertion of the magnet during assemply.

The selector card magnet is assembled into the selector card by pushing it into place. The two projections of the selector card snap over either end of the magnet as it is assembled. The ramp arrangement guiding the magnet and resiliently separating for its passage. The projections provide force in two directions to keep the magnet both centered and rigidly fixed in place with no play. If the magnet were to change position, it would change the critical operating characteristics of the coin relay assembly.

The particular arrangement of the snap fit is necessary to provide the aforementioned fit as well as because of space, geometry, and manufacturability restrictions. As mentioned before, the magnet must be located at the extreme top end of the selector card. This means that the snap in projections must be below the permanent magnet and not between the permanent magnet and the magnetic pole pieces.

What is claimed is:

1. A selector card for use in a coin handling mechanism of a paystation comprising:

a generally deltoid shaped planar card including;

a permanent magnet bar of approximately the length of a first side of said card, a first tongue shaped projection from a first side of said deltoid shaped planar card, said first tongue shaped projection including a terminal end of saddle shape for confining said bar magnet along 3 of its axial sides; and a pair of tines at each side of said tongue shaped projection for axially restraining said bar magnet.

2. A selector card as claimed in claim 1, wherein said pair of tines further include a tab for restraining said magnet along its fourth axial side.

3. A selector card as claimed in claim 1 or 2, wherein said pair of tines are of sufficient flexibility to permit distortion thereof for inserting said bar magnet.

4. A selector card as claimed in claim 3, wherein said pair of tines include a ramp for facilitating insertion of said magnet.

* * * * *